US012398899B2

(12) United States Patent
Wirth

(10) Patent No.: US 12,398,899 B2
(45) Date of Patent: Aug. 26, 2025

(54) ACTIVE AIRFLOW INHIBITING APPARATUS

(71) Applicant: Wirth Doors Limited, Oxfordshire (GB)

(72) Inventor: Nicholas Wirth, Northamptonshire (GB)

(73) Assignee: Wirth Doors Limited, Bicester (GB)

( * ) Notice: Subject to any disclaimer, the term of this patent is extended or adjusted under 35 U.S.C. 154(b) by 494 days.

(21) Appl. No.: 17/607,580

(22) PCT Filed: Apr. 30, 2020

(86) PCT No.: PCT/EP2020/062037
§ 371 (c)(1),
(2) Date: Oct. 29, 2021

(87) PCT Pub. No.: WO2020/221863
PCT Pub. Date: Nov. 5, 2020

(65) Prior Publication Data

US 2022/0349598 A1 Nov. 3, 2022

(30) Foreign Application Priority Data

Apr. 30, 2019 (GB) ..... 1906016

(51) Int. Cl.
*F24F 9/00* (2006.01)
*F24F 11/30* (2018.01)
(Continued)

(52) U.S. Cl.
CPC ..... *F24F 9/00* (2013.01); *F24F 11/30* (2018.01); *F24F 2009/005* (2013.01);
(Continued)

(58) Field of Classification Search
CPC ..... F24F 9/00; F24F 11/30; F24F 2110/32; F24F 2110/40; F24F 2009/005; F24F 2009/007
(Continued)

(56) References Cited

U.S. PATENT DOCUMENTS 983,877 A 2/1911 Cummings
3,190,207 A 6/1965 Weisz
(Continued)

FOREIGN PATENT DOCUMENTS

CN 1909817 A 2/2007
CN 106949590 A 7/2017
(Continued)

OTHER PUBLICATIONS

Chinese Office Action, Application No. 2020800481749, dated Oct. 20, 2022.
(Continued)

*Primary Examiner* — Avinash A Savani
*Assistant Examiner* — Dana K Tighe
(74) *Attorney, Agent, or Firm* — Honigman, LLP

(57) ABSTRACT

An active airflow inhibiting apparatus for an entranceway comprises: a structure positioned adjacent an entranceway of a building and defines a passage therethrough for accessing the entranceway. The structure defines at least one plenum chamber and first and second outlet slots fluidically coupled to the plenum chamber. A fan fluidically connected to the plenum chamber supplies an airflow to the plenum chamber in order to selectively form a jet of air from the first outlet slot in a first mode of operation and from the second outlet slot in a second mode of operation The first and second outlet slots are configured so that the respective jets of air are each directed towards a centre of the structure, with the jet of air from the first outlet slot being directed away from the
(Continued)

entranceway and the jet of air from the second outlet slot being directed towards the entranceway.

20 Claims, 4 Drawing Sheets

(51) Int. Cl.
*F24F 110/32* (2018.01)
*F24F 110/40* (2018.01)

(52) U.S. Cl.
CPC ..... *F24F 2009/007* (2013.01); *F24F 2110/32* (2018.01); *F24F 2110/40* (2018.01)

(58) Field of Classification Search
USPC ..... 454/188
See application file for complete search history.

(56) References Cited

U.S. PATENT DOCUMENTS 3,207,056 A 9/1965 Flebu
3,350,994 A * 11/1967 Guibert ..... F24F 9/00 454/190
6,620,038 B1 9/2003 Kikuchi et al.
6,702,663 B2 * 3/2004 Israel ..... F24F 9/00 454/190
8,376,822 B1 * 2/2013 Smith ..... A61N 7/02 454/188
10,449,844 B2 * 10/2019 Le Bastard ..... B61D 19/02
2010/0184365 A1 * 7/2010 Brzezinski ..... F24F 9/00 454/189
2014/0179217 A1 6/2014 Deweerdt

FOREIGN PATENT DOCUMENTS

EP 2942577 A1 11/2015
GB 2563474 A 12/2018
JP S-5541335 A 3/1980

OTHER PUBLICATIONS

Combined Search and Examination Report, Application No. GB19060169, mailed Oct. 1, 2019.
International Search Report, Application No. PCT/EP2020/062037, mailed Oct. 6, 2020.

* cited by examiner

ACTIVE AIRFLOW INHIBITING APPARATUS

CROSS-REFERENCE TO RELATED APPLICATIONS

This application is the U.S. national stage of PCT/EP2020/062037 filed on Apr. 30, 2020, which claims priority of Great Britain Application No. GB1906016.9 filed on Apr. 30, 2019, the contents of which are incorporated herein.

TECHNICAL FIELD

The disclosure relates to an active airflow inhibiting apparatus for an entranceway, and particularly a doorway.

BACKGROUND

Various styles of doors are used at the entrances of retail spaces, such as shopping centres (malls), supermarkets or other stores.

A common style of door is the automatic sliding door. Two sets of automatic sliding doors are often provided in series to form a draught lobby which acts as an airlock to prevent wind from entering the building. However, in high traffic areas, it is common for both sets of doors to be open at the same time, thus providing a direct path for air to pass through the door. This can lead to unpleasant draughts. In addition, airflow may occur through a door as a result of temperature differentials across the door. Airflow through a door (whether from draughts or induced by temperature differentials) increases the power output requirements of HVAC systems within the building.

Over door heaters are often used to try to mask the incoming draught to improve customer experience. However, these devices consume large amounts of energy and do not address the problem itself. Another option is to provide an air curtain across the doorway. However, these devices are not able to prevent infiltration where there is a large pressure differential or under windy conditions.

Experience has shown that any physical barrier, even an automatically opening door, can lead to a reduction in the number of people entering a store and that stores have started keeping the doors open throughout all of the working hours to minimise this effect. In this case, the energy costs through the passage of heated or cooled air out of the building and replaced by ambient air can be substantial.

It is therefore desirable to provide an airflow inhibiting apparatus which addresses the disadvantages of existing solutions.

SUMMARY

In accordance with an aspect of the disclosure, there is provided an active airflow inhibiting apparatus for an entranceway of a building comprising: a structure configured to be positioned adjacent the entranceway and defining a passage therethrough for accessing the entranceway; wherein the structure defines at least one plenum chamber and first and second outlet slots fluidically coupled to the at least one plenum chamber; a fan fluidically connected to the plenum chamber for supplying an airflow to the at least one plenum chamber in order to selectively form a jet of air from the first outlet slot in a first mode of operation and from the second outlet slot in a second mode of operation; wherein the first and second outlet slots are configured so that the respective jets of air are each directed towards a centre of the structure, with the jet of air from the first outlet slot being directed away from the entranceway and the jet of air from the second outlet slot being directed towards the entranceway.

The at least one plenum chamber may be fluidically coupled to the first outlet slot via a first curved passageway and fluidically coupled to the second outlet slot via a second curved passageway.

A valve may be disposed between the at least one plenum chamber and the first and second outlet slots, the valve being selectively controllable to change between the first and second modes of operation.

The structure may comprise a Coandă surface and the first and second outlet slots may be spaced from one another along the Coandă surface.

The Coandă surface may be inclined with respect to the plane of the entrance.

The Coandă surface may be configured to guide the jet of air from the second outlet slot along its length past the first outlet slot and towards the entranceway.

The first outlet slot may extend around an inner perimeter of the structure and the second outlet slot may extend around an outer perimeter of the structure.

The structure may have a triangular cross-section which tapers towards its inner perimeter.

The structure may form an archway.

The active airflow inhibiting apparatus may further comprise: a controller configured to control the jet of air from the first and second outlet slots to provide a differential pressure across the structure which inhibits airflow through the entranceway.

The apparatus may comprise a plurality of said structures and each of the plurality of said structures may be configured to be positioned adjacent a different entranceway of the same building.

The controller may be configured to determine a set of operating parameters (e.g. fan speed setting, valve position, etc.) for the plurality of structures which are dependent on one another.

The active airflow inhibiting apparatus may further comprise: an airflow sensor configured to provide an output indicative of speed and direction of airflow through the entranceway or at the structure; and the controller may be configured to receive the output of the airflow sensor and to control the jet of air based on the received output so as to generate a differential pressure across the structure which inhibits airflow through the entranceway.

The airflow sensor may be configured to provide an output indicative of speed and direction of airflow through the entranceway at a plurality of vertical positions through the entranceway.

The airflow sensor may comprise a plurality of sensor elements located at different vertical positions.

The controller may be configured to control the jet of air so as to generate a differential pressure which varies with vertical position.

The controller may be configured to synchronise the operation of the fans with the opening of a door of the entranceway based on the output of an activation sensor.

The activation sensor may be located within the passage defined by the structure.

The jet of air may be controlled by changing a fan speed setting.

The structure may be configured to be located externally to the entranceway.

BRIEF DESCRIPTION OF DRAWINGS

For a better understanding of the disclosure, and to show more clearly how it may be carried into effect, reference will now be made, by way of example, to the accompanying drawings, in which.

DETAILED DESCRIPTION OF PREFERRED EMBODIMENTS

Figure 1:
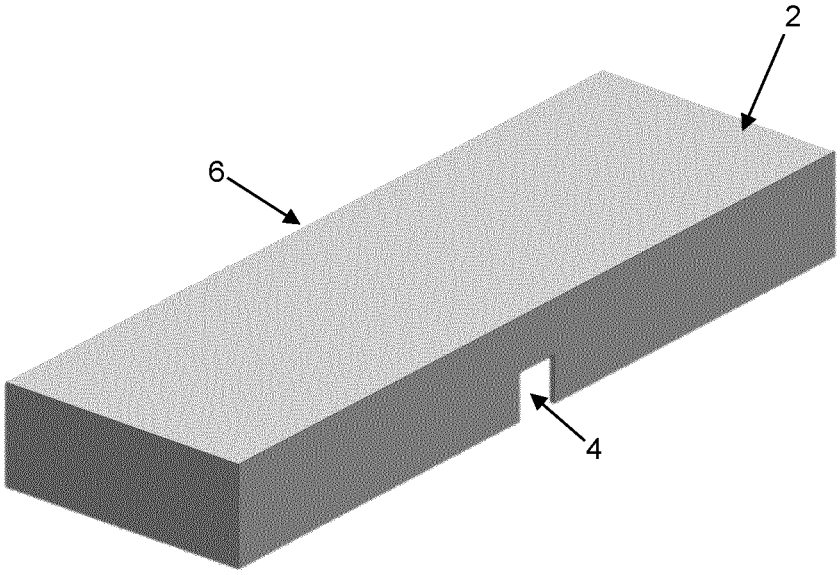
FIG. 1 is a model of a store building.
Figure 2:
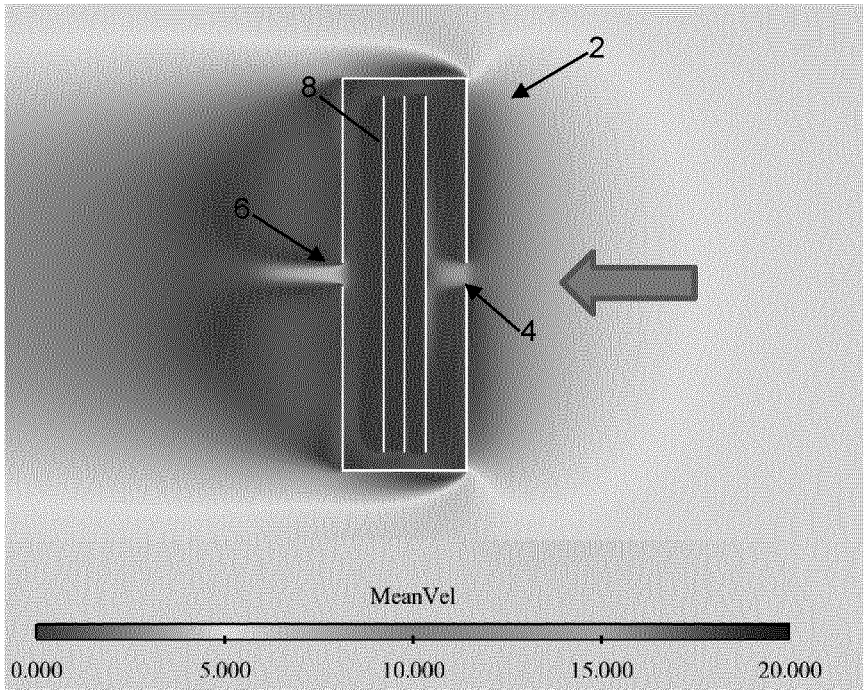
FIG. 2 is an airflow velocity plot over a plan view of the store building showing airflow around and through the building.

FIGS. 1 and 2 show a simplified model of a store building 2, such as a supermarket or other retail space. As shown, in this example, the building 2 has a front entrance 4 and a rear entrance 6 located opposite the front entrance 4. The front and rear entrances 4, 6 are shown as open doorways to signify that a door located at the entrance is in an open position and so not covering the doorway. In particular, the front and rear entrances 4, 6 may utilise automatic sliding doors and so the model shown in FIG. 1 represents where customers are passing simultaneously through the front and rear entrances 4, 6.

As shown in FIG. 2, internally, the space within the building 2 is divided into a number of aisles by dividers 8.

With wind directed towards the front entrance 4 as shown in FIG. 2, air is allowed to flow into the building 2 via the front entrance 4 and is drawn through the building 2 before exiting the building 2 via the rear entrance 6. A strong current of air (draught) is therefore generated through the interior of the building 2. This may be unpleasant for customers and employees located within the building 2.

Figure 3:
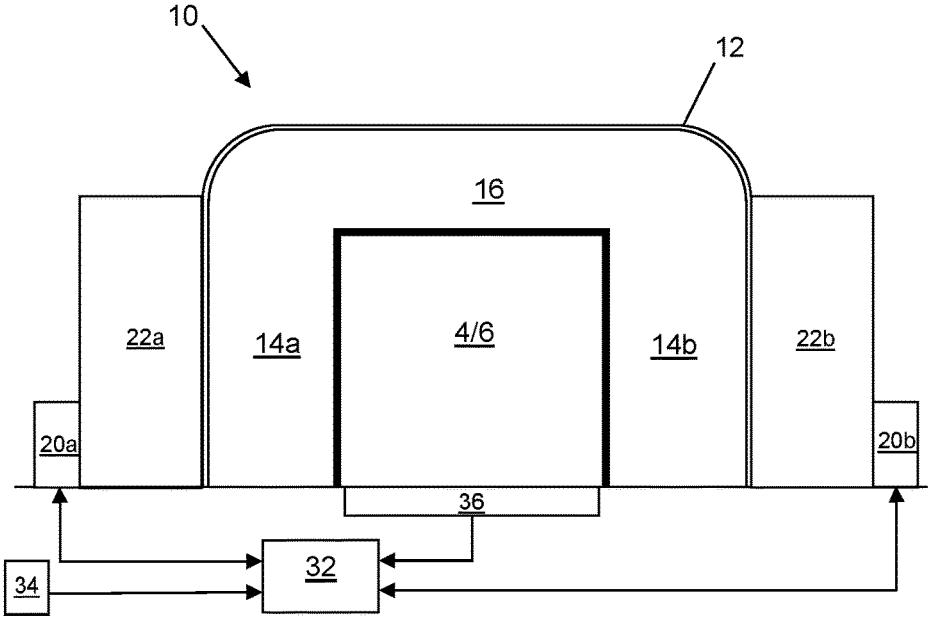
FIG. 3 is a front view of an airflow inhibiting apparatus according to an embodiment of the disclosure.
Figure 4:
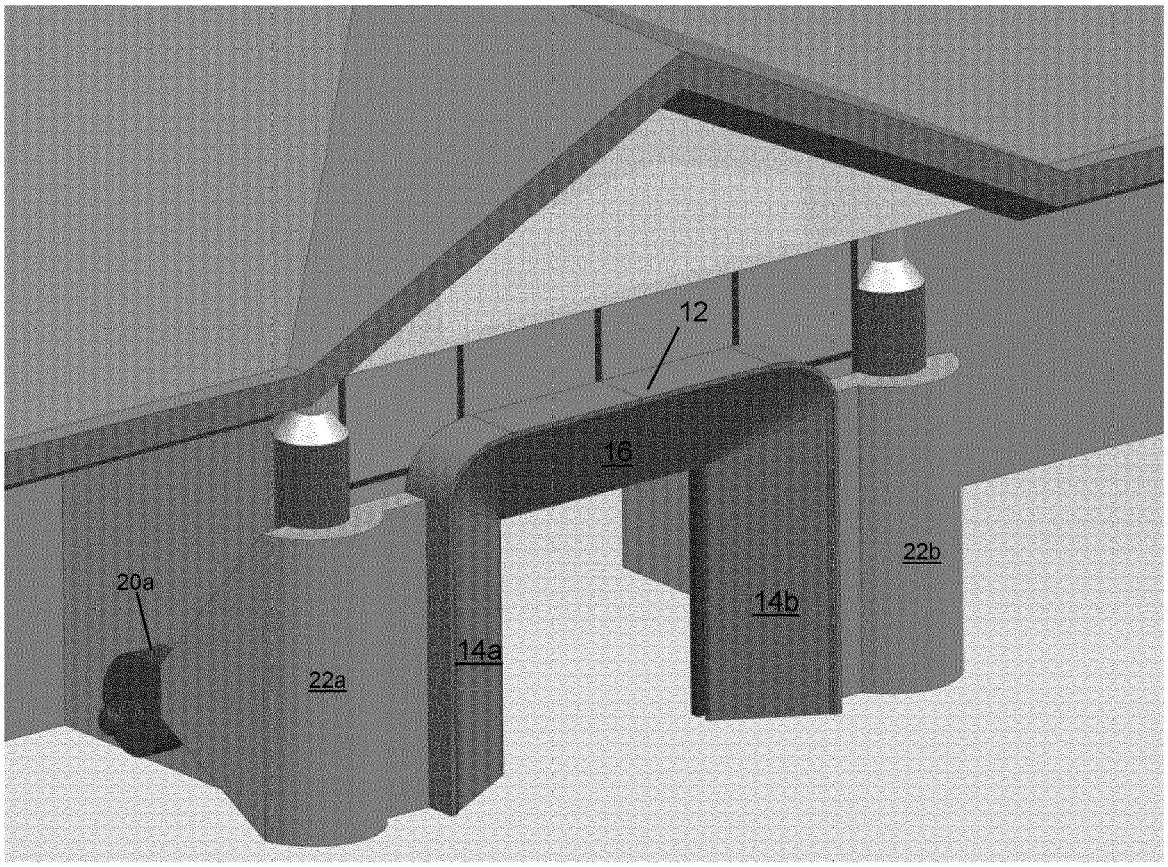
FIG. 4 is a perspective view of the airflow inhibiting apparatus.

FIGS. 3 and 4 show an airflow inhibiting apparatus 10 which may be provided adjacent the front entrance 4 and/or rear entrance 6 and seeks to reduce or eradicate entirely such draughts through the building.

As shown in FIG. 3, the airflow inhibiting apparatus 10 comprises a structure 12 which is positioned adjacent the entrance 4, 6 on the exterior of the building 2. In particular, the structure 12 may be disposed against an external wall of the building 2. The structure 12 forms an arch which extends around the entrance 4, 6 such that it does not impede the doorway. Specifically, the structure 12 comprises first and second vertical sections 14*a*, 14*b* which extend along either side of the entrance 4, 6 and a horizontal section 16 which is disposed above the entrance 4, 6. The first and second vertical sections 14*a*, 14*b* transition into the horizontal section 16 at first and second corner sections.

Figure 5:
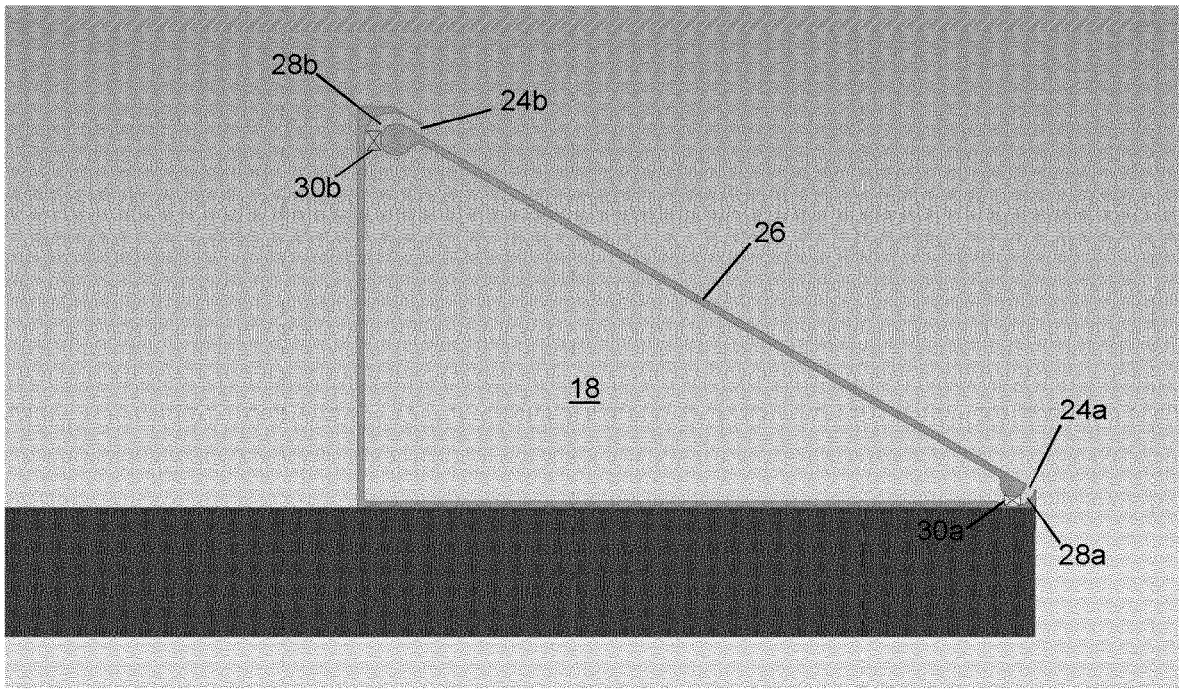
FIG. 5 is a cross-section through a portion of the airflow inhibiting apparatus.

As shown in FIG. 5, the structure 12 is hollow and forms a plenum chamber 18. The plenum chamber 18 may be continuous or may be divided into a plurality of discrete sections. For example, the plenum chamber 18 may be divided into two discrete sections along the axis of symmetry of the structure 12.

As shown in FIGS. 3 and 4, the structure 12 is fluidically connected to a pair of fans 20*a*, 20*b* via first and second ducts 22*a*, 22*b*. Specifically, the first duct 22*a* connects the fan 20*a* to the first vertical section 14*a* of the structure 12 and the second duct 22*b* connects the 20*b* to the second vertical section 14*b* of the structure 12.

The structure 12 defines a first outlet slot 24*a* and a second outlet slot 24*b* which are fluidically coupled to the plenum chamber 18. As shown, the first outlet slot 24*a* extends around an inner perimeter of the structure 12 at or adjacent the perimeter of the entrance and the second outlet slot 24*b* extends around an outer perimeter of the structure 12. The first outlet slot 24*a* is thus nested within the second outlet slot 24*b* (i.e. they are concentric or coaxial) and the second outlet slot 24*b* is spaced from the first outlet slot 24*a* and the perimeter of the entrance.

The second outlet slot 24*b* is spaced from the first outlet slot 24*a* along a Coandă surface 26. The Coandă surface 26 is inclined with respect to the plane of the entrance (i.e. neither parallel nor perpendicular to the plane of the entrance) such that the second outlet slot 24*b* is spaced further from the plane of the entrance than the first outlet slot 24*a*. The structure 12 therefore has a generally triangular (specifically, a right-angled triangular) cross-section and is thus wedge-shaped (specifically, a right triangular prism) tapering towards its inner perimeter adjacent the entrance.

The first outlet slot 24*a* is coupled to the plenum chamber 18 via a first curved passageway 28*a* and the second outlet slot 24*b* is coupled to the plenum chamber 18 via a second curved passageway 28*b*.

A first valve 30*a* is provided between the first outlet slot 24*a* and plenum chamber 18 (e.g. in the first curved passageway 28*a*) and a second valve 30*b* is provided between the second outlet slot 24*b* and plenum chamber (e.g. in the second curved passageway 28*b*). The first and second valves 30*a*, 30*b* may be gate valves. The first and second valves 30*a*, 30*b* act in unison to selectively open one of the first and second outlet slots 24*a*, 24*b* at a time, as will be described further below. It will be appreciated that in other examples, a single valve may be able to simultaneously open one of the first and second outlet slots 24*a*, 24*b* and close the other of the first and second outlet slots 24*a*, 24*b*.

The fans 20*a*, 20*b* provide an airflow to the plenum chamber 18 to form a pressurised volume within the structure 12. The air is released from the plenum chamber 18 via one of the first and second outlet slots 24*a*, 24*b*, forming a jet of air.

The first and second curved passageways 28*a*, 28*b* act to direct the jet of air in the desired direction. Specifically, the first and second curved passageways 28*a*, 28*b* both act to direct the respective jets of air from the first and outlet slots 24*a*, 24*b* so that they are directed towards the centre of the structure 12. In other words, the air from the first vertical section 14*a* is directed towards the opposing second vertical section 14*b*, and vice versa, and the air from the vertical section is directed downwards towards the ground. However, the first curved passageway 28*a* acts to direct the jet of air from the first outlet slot 24*a* so that it is directed away from the entrance and the interior of the building 2, whereas the second curved passageway 28*b* acts to direct the jet of air from the second outlet slot 24*b* so that it is directed towards the entrance and the interior of the building 2. Specifically, the second curved passageway 28*b* acts to direct the jet of air from the second outlet slot 24*b* so that it flows along the Coandă surface 26 towards the first outlet slot 24*a*. The Coandă surface 26 causes the jet of air to form a laminar boundary layer along its length.

The fans 20*a*, 20*b* and the structure 12 form an air mover device. Specifically, the air mover device is a bidirectional air multiplier having a first mode of operation in which a jet of air is ejected from the first outlet slot 24*a* and a second mode of operation in which a jet of air is ejected from the second outlet slot 24*b*. In either mode, the jet of air creates an area of negative pressure which draws additional air into the airflow from around the structure 12. Further, as the air moves away from the structure 12 it entrains additional air within the airflow. The volume of air within the airflow is thus multiplied. The selection of the first and second modes of operation may be controlled by an internal controller of the air mover device which operates the valves 30*a*, 30*b*.

The air mover device 12 is connected (either via a wired or wireless connection) to a controller 32 which is in turn connected (again, either via a wired or wireless connection) to an airflow sensor 34 and an activation sensor 36.

The activation sensor 36 may be a pressure sensor or a movement sensor (such as a passive infra-red sensor or the like) which provides a signal that indicates when someone passes through the structure 12 prior to entering the building 2 via the entrance 4, 6.

The airflow sensor 34 provides an output which is indicative of the present wind conditions, particularly the wind speed and direction.

The controller 32 receives as inputs the signals from the activation sensor 36 and the airflow sensor 34. The controller 32 uses these signals to control the operation of the air mover device. Specifically, the controller 32 sets a fan speed setting of the fans 20*a*, 20*b* based on the speed and direction of the wind. The fan speed setting is set to create a pressure differential which opposes the approaching wind and is sufficient to cause it to be substantially stopped, redirected or reversed.

Figure 6:
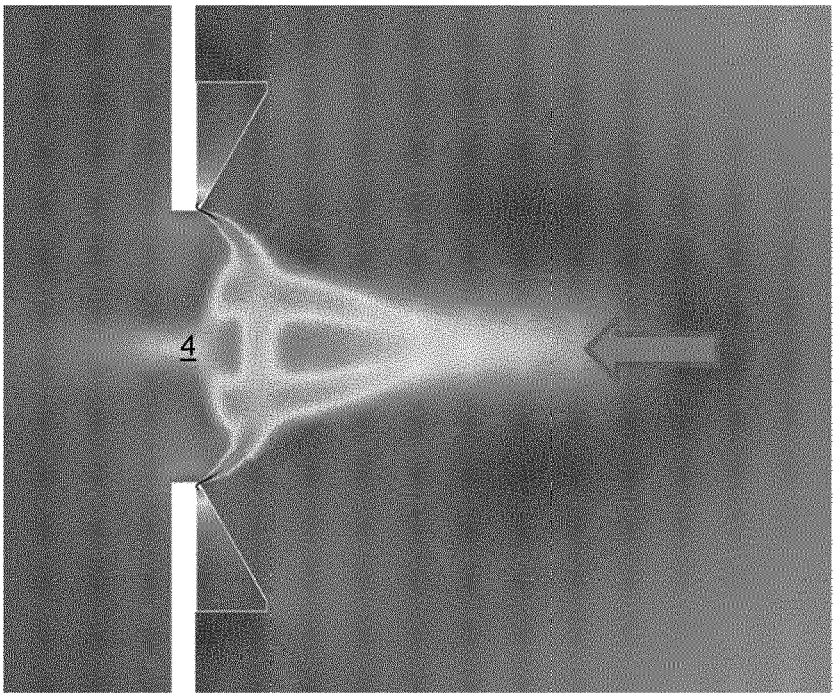
FIG. 6 is an airflow velocity plot over a plan view of the building showing airflow adjacent the front entrance with the airflow inhibiting apparatus in use.
Figure 7:
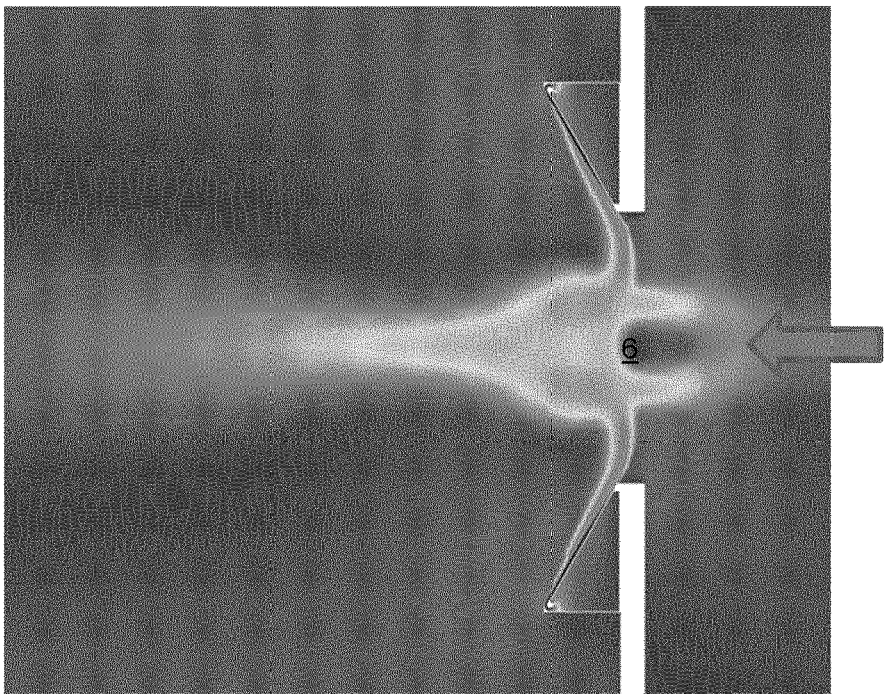
FIG. 7 is an airflow velocity plot over a plan view of the building showing airflow adjacent the rear entrance with the airflow inhibiting apparatus in use.

FIG. 6 shows the airflow velocity at the front entrance 4 where the wind enters the building 2, and FIG. 7 shows the airflow velocity at the rear entrance 6 where the wind exits the building 2. The air mover device at the front entrance 4 is configured to operate in the first mode of operation where a jet of air is ejected from the first outlet slot 24*a* and the air mover device at the rear entrance 6 is configured to operate in the second mode of operation in which a jet of air is ejected from the second outlet slot 24*b*. As shown, at both locations, the wind is prevented from passing through the structure 12 and thus the adjacent doorway, thus creating stagnant conditions within the building 2. The fan speed setting can be controlled based on the speed and direction of the wind to ensure that the jet of air has sufficient power to prevent the wind from passing through the structure 12.

The operation of the air mover device is also coordinated based on the signals of the activation sensor 36. Specifically, the fans 20*a*, 20*b* may only be switched on or operated at the required fan speed (differential pressure) setting when someone is approaching the front entrance and the door will open allowing a draft to be formed. A corresponding sensor may be provided inside the building 2 to indicate when the door will be triggered by someone leaving the building 2.

If the wind direction were reversed such that air entered the rear entrance 6 of the building and exited the front entrance 4, the air mover devices would be operated in the opposite configurations.

The controller 32 is able to actively manage the operation of the air mover devices to prevent or minimise draughts at all times, regardless of the current wind conditions. The controller 18 may access a look-up table or other reference source to determine the correct setting for the current wind conditions.

The controller 32 may be in communication with each of the air mover devices at the front and rear entrances 4, 6 and thus be able to make local adjustments to prevent airflow either into or out of the respective doorways. The effect of each of the arrays has an impact on the other arrays and so the settings for the arrays cannot be determined in isolation. Consequently, the controller 32 determines a set of outputs for the air mover devices which are dependent on one another. In particular, the controller 32 may perform a multivariate analysis (or other analysis) which seeks to define the optimum overall solution (particularly, with the minimum energy usage).

Although the airflow inhibiting apparatus 10 has been described in relation to airflows generated by wind, it will be appreciated that it may also minimise or prevent airflows associated with temperature differentials at a doorway (i.e. in the absence of any wind or draught). Such temperature differentials lead to both ingress and egress at the doorway as a result of buoyancy effects. Specifically, higher density, colder air flows in one direction at the lower part of the door plane and lower density, warmer air flows in the opposite direction at the upper part of the door plane in order to maintain net building pressure.

In such circumstances, the airflow sensor 34 is able to determine the current airflow through the doorway at a plurality of vertical positions (for example, by utilising a plurality of sensor elements located at different vertical positions). The controller 32 is able to utilise the output of the airflow sensor 34 to control the output of the air mover device to vary with vertical position. Specifically, the air mover device is able to generate a stratified differential pressure which provides a negative pressure over part of the doorway and a positive pressure over another part of the same doorway in order to counteract the opposing flows through the doorway generated by buoyancy effects.

The airflow may also vary vertically and/or horizontally, while generating a positive or negative pressure all around the structure 12, to take into account variations in wind conditions and directions.

The front of the building may comprise a recess (for example, being dished inwardly), with the doorway being positioned within the recess so that it is set back from the boundary of the building. This arrangement may allow the structure 12 to be sited within or at the boundary of the building (although still external to the doorway).

The preceding description describes how the output of the air mover devices is controlled by adjusting a fan speed setting. In other arrangements, the output of the air mover devices may be adjusted in other manners. For example, the output may be adjusted by controlling valves/chokes (such as the valves 30*a*, 30*b*) or by adjusting the size of the outlet slots 24*a*, 24*b*.

Although the airflow sensor 34 is shown as being adjacent to the structure 12, it will be appreciated that the airflow sensor may be located remotely provided that it gives an adequate indication of the current wind conditions at that location.

The activation sensor 36 may be omitted in other examples or may be formed by the opening sensor of the door itself.

In other examples, the structure 12 may not form an arch. For example, the structure may comprise a pair of vertical sections (with a passage therebetween), and optionally, a horizontal section. Further, it is not necessary for the entire arch to generate airflow. For example, the first and second slots 24*a*, 24*b* may not extend over the corners of the arch.

The airflow may be provided by any number of fans. The or each fan may also connect directly to the plenum chamber rather than via an intermediate duct.

Although it has been described that the structure 12 has first and second outlet slots 24*a*, 24*b*, it will be appreciated that the first and second outlet slots 24*a*, 24*b* may be divided into a plurality of discrete sections.

The airflow inhibiting apparatus 10 may only be provided on a single entrance of a building. In particular, this may be sufficient to prevent airflow through the building even when there are other entrances.

The airflow inhibiting apparatus 10 is able to inhibit airflow (generated by wind and/or temperature differentials) through a doorway (or any other entranceway) without requiring any physical obstruction. This improves customer experience and reduces power consumption of HVAC systems operating within the building.

The disclosure is not limited to the embodiments described herein, and may be modified or adapted without departing from the scope of the present disclosure, as defined by the claims.

The invention claimed is:

1. An active airflow inhibiting apparatus for an entranceway of a building comprising:

a structure configured to be positioned adjacent the entranceway and defining a passage therethrough for accessing the entranceway;

wherein the structure defines at least one plenum chamber and first and second outlet slots fluidically coupled to the at least one plenum chamber;

a fan fluidically connected to the at least one plenum chamber for supplying an airflow to the at least one plenum chamber in order to selectively form a jet of air from the first outlet slot and not the second outlet slot in a first mode of operation and from the second outlet slot and not the first outlet slot in a second mode of operation;

wherein the first and second outlet slots are configured so that the respective jets of air are each directed towards a center of the structure, with the jet of air from the first outlet slot being directed away from the entranceway and the jet of air from the second outlet slot being directed towards the entranceway.

2. The active airflow inhibiting apparatus as claimed in claim 1, wherein the at least one plenum chamber is fluidically coupled to the first outlet slot via a first curved passageway and is fluidically coupled to the second outlet slot via a second curved passageway.

3. The active airflow inhibiting apparatus as claimed in claim 1, wherein a valve is disposed between the at least one plenum chamber and the first and second outlet slots, the valve being selectively controllable to change between the first and second modes of operation.

4. The active airflow inhibiting apparatus as claimed in claim 1, wherein the structure comprises a Coandă surface and the first and second outlet slots are spaced from one another along the Coandă surface.

5. The active airflow inhibiting apparatus as claimed in claim 4, wherein the Coandă surface is inclined with respect to the plane of the entrance.

6. The active airflow inhibiting apparatus as claimed in claim 4, wherein the Coandă surface is configured to guide the jet of air from the second outlet slot along its length past the first outlet slot and towards the entranceway.

7. The active airflow inhibiting apparatus as claimed in claim 1, wherein the first outlet slot extends around an inner perimeter of the structure and the second outlet slot extends around an outer perimeter of the structure.

8. The active airflow inhibiting apparatus as claimed in claim 1, wherein the structure has a triangular cross-section which tapers towards its inner perimeter.

9. The active airflow inhibiting apparatus as claimed in claim 1, wherein the structure forms an archway.

10. The active airflow inhibiting apparatus as claimed in claim 1, further comprising:

a controller configured to control the jet of air from the first and second outlet slots to provide a differential pressure across the structure which inhibits airflow through the entranceway.

11. The active airflow inhibiting apparatus as claimed in claim 10, wherein the apparatus comprises a plurality of said structures and wherein each of the plurality of said structures is configured to be positioned adjacent a different entranceway of the same building.

12. The active airflow inhibiting apparatus as claimed in claim 11, wherein the controller is configured to determine a set of operating parameters for the plurality of structures which are dependent on one another.

13. The active airflow inhibiting apparatus as claimed in claim 10, further comprising:

an airflow sensor configured to provide an output indicative of speed and direction of airflow through the entranceway or at the structure; and wherein the controller is configured to receive the output of the airflow sensor and to control the jet of air from the first and second outlet slots based on the received output so as to generate the differential pressure across the structure which inhibits the airflow through the entranceway.

14. The active airflow inhibiting apparatus as claimed in claim 13, wherein the airflow sensor is configured to provide the output indicative of the speed and direction of the airflow through the entranceway at a plurality of vertical positions through the entranceway.

15. The active airflow inhibiting apparatus as claimed in claim 14, wherein the controller is configured to control the jet of air from the first and second outlet slots so as to generate a differential pressure which varies with vertical position.

16. The active airflow inhibiting apparatus as claimed in claim 13, wherein the airflow sensor comprises a plurality of sensor elements located at different vertical positions.

17. The active airflow inhibiting apparatus as claimed in claim 10, wherein the controller is configured to synchronise the operation of the fan with the opening of a door of the entranceway based on an output of an activation sensor.

18. The active airflow inhibiting apparatus as claimed in claim 17, wherein the activation sensor is located within the passage defined by the structure.

19. The active airflow inhibiting apparatus as claimed in claim 10, wherein the jet of air from the first and second outlet slots is controlled by changing a fan speed setting.

20. The active airflow inhibiting apparatus as claimed in claim 1, wherein the structure is configured to be located externally to the entranceway.

* * * * *